US011572988B2

(12) United States Patent
Ai et al.

(10) Patent No.: US 11,572,988 B2
(45) Date of Patent: Feb. 7, 2023

(54) HALF-PACKAGED FLEXIBLE LIGHT STRIP

(71) Applicant: Dongguan ZOYO Electronics Technology Co., LTD., Guangdong (CN)

(72) Inventors: Shaochun Ai, Guangdong (CN); Lunjun Chen, Guangdong (CN)

(73) Assignee: DONGGUAN ZOYO ELECTRONICS TECHNOLOGY CO., LTD., Dongguan (CN)

( * ) Notice: Subject to any disclaimer, the term of this patent is extended or adjusted under 35 U.S.C. 154(b) by 0 days.

(21) Appl. No.: 17/305,882

(22) Filed: Jul. 16, 2021

(65) Prior Publication Data

US 2022/0243878 A1 Aug. 4, 2022

(30) Foreign Application Priority Data

Jan. 29, 2021 (CN) ..... 202120255370.5

(51) Int. Cl.

| | |
|---|---|
| ***F21S 4/22*** | (2016.01) |
| ***F21V 19/00*** | (2006.01) |
| ***F21V 3/02*** | (2006.01) |

(52) U.S. Cl.

CPC *F21S 4/22* (2016.01); *F21V 3/02* (2013.01); *F21V 19/0015* (2013.01)

(58) Field of Classification Search

CPC ..... F21V 3/02; F21V 19/0015; F21V 19/008–009

See application file for complete search history.

(56) References Cited

U.S. PATENT DOCUMENTS

2013/0088863 A1* 4/2013 Park ..... F21K 9/66 362/217.1

FOREIGN PATENT DOCUMENTS

| | | | | |
|---|---|---|---|---|
| CN | 104776332 A | * | 7/2015 | ..... F21V 19/009 |
| CN | 206771065 U | * | 12/2017 | |
| DE | 102012210742 A1 | * | 1/2014 | ..... F21S 4/22 |

* cited by examiner

*Primary Examiner* — Anabel Ton

(74) *Attorney, Agent, or Firm* — Shimokaji IP

(57) ABSTRACT

A half-enclosed flexible light strip includes a flexible circuit board, a transparent cover with a half-enclosed structure and a plurality of light sources. The plurality of light sources and the transparent cover are all arranged on the same surface of the flexible circuit board. The light sources are located between the transparent cover and the flexible circuit board. The transparent cover is formed by co-extrusion process and connected to the flexible circuit board. The transparent cover with a half-enclosed structure is formed onto the flexible circuit board by co-extrusion process, the use of glue is reduced, so that the light emitted from the two sides of the transparent cover will not cause color drift problem, and this arrangement ensures the consistency of the luminous effect in all directions, thereby improving the light strip use effect.

8 Claims, 2 Drawing Sheets

HALF-PACKAGED FLEXIBLE LIGHT STRIP

RELATED APPLICATIONS

This application claims the benefits of Chinese Patent Application No. 202120255370.5, filed on Jan. 29, 2021, which is hereby incorporated by reference in this application.

FIELD OF THE INVENTION

The present invention relates to the technical field of light-emitting device, and more particularly to a half packaged flexible light strip.

BACKGROUND OF THE INVENTION

The flexible light strip is a light-emitting device that can be mounted flexibly. The flexible light strip is currently popularly used for on-site arrangements such as event ceremonies, and can produce a variety of lighting effects to enhance the atmosphere of the scene. For the existing flexible light strip, the manufacturing process is generally to completely cover the flexible printed circuit with a transparent cover to ensure that the light source on the flexible printed circuit is isolated from the outside, thereby increasing the life span of the flexible light strip. However, in this way, much glue is required to connect the transparent cover with the flexible printed circuit, and the glue will affect the light-transmittance of the transparent cover and cause color shift.

SUMMARY OF THE INVENTION

Objective of the present invention is to provide a half packaged flexible light strip which can ensure the consistency of the light effect.

To achieve the above-mentioned objective, a half packaged flexible light strip includes a flexible circuit board, a transparent cover with a half-packaged structure and a plurality of light sources. The plurality of light sources and the transparent cover are all arranged on the same surface of the flexible circuit board. The plurality of the light sources is located between the transparent cover and the flexible circuit board. Only the surface of the flexible circuit board that has the light sources is packaged by the transparent cover, and the other surface of the flexible circuit board is not packaged by the transparent cover. The transparent cover is formed by co-extrusion process and connected to the flexible circuit board.

Preferably, an accommodating space is provided between the transparent cover and the flexible circuit board, and the plurality of light sources is all located in the accommodating space and all at a certain distance from an inner surface of the transparent cover.

Preferably, the light strip further includes two end caps which are respectively arranged at two ends of the accommodating space, and two end caps seal openings at both ends of the accommodating space.

Preferably, an adhesive coating is coated between the transparent cover and the flexible circuit board.

Preferably, the transparent cover is made of silica gel.

Preferably, the plurality of light sources is connected to the flexible circuit board by welding.

The technical effects are as follows. The transparent cover with a half-packaged structure is formed onto the flexible circuit board, the use of glue is reduced, so that the light emitted from the two sides of the transparent cover will not cause color drift problem, and this arrangement ensures the consistency of the luminous effect in all directions, thereby improving the light strip use effect.

BRIEF DESCRIPTION OF THE DRAWINGS

The accompanying drawings facilitate an understanding of the various embodiments of this invention. In such drawings.

In the aforementioned Figures.

Figure 1:
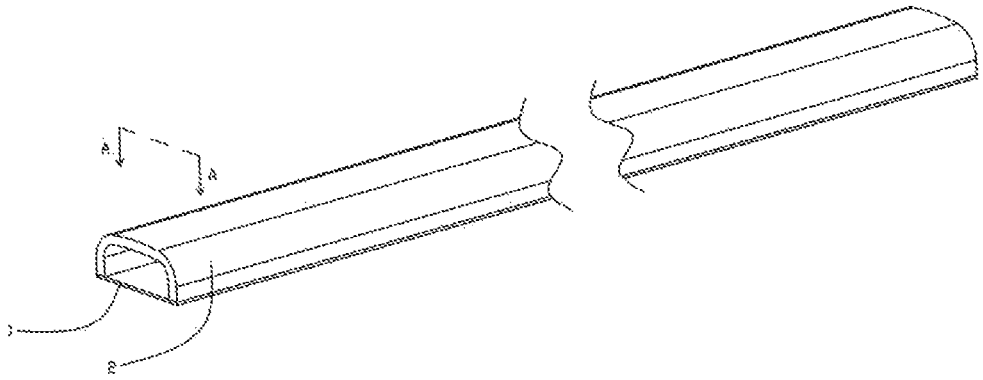
FIG. 1 is a perspective view of a light strip according to an embodiment of the present invention.
Figure 2:
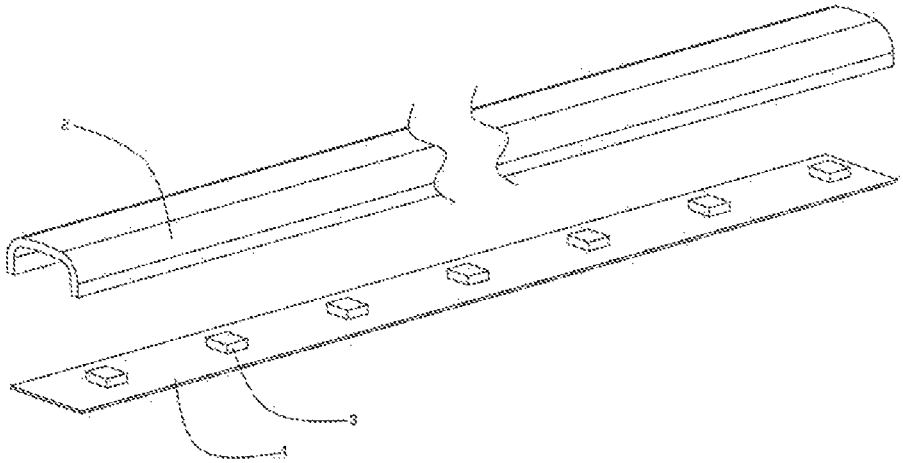
FIG. 2 is an exploded view of the light strip.
Figure 3:
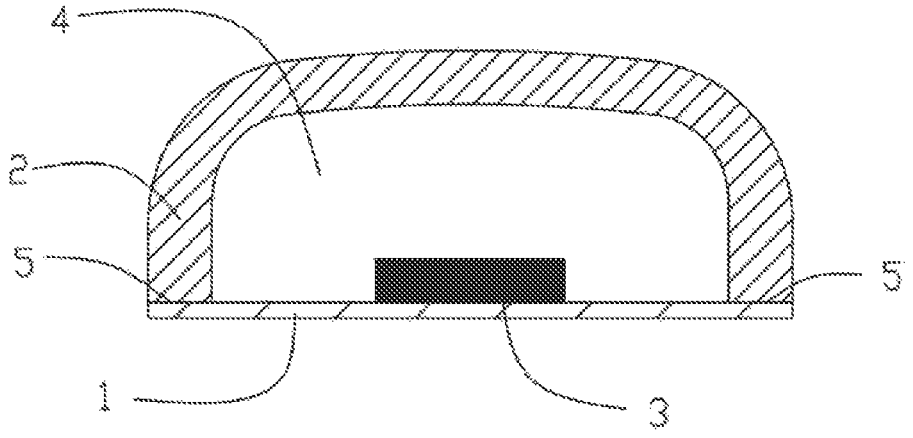
FIG. 3 is a cross-sectional view of FIG. 1 along A-A.

1, flexible circuit board; 2, transparent cover; 3, light source; 4, accommodating space; 5, adhesive coating.

DETAILED DESCRIPTION OF ILLUSTRATED EMBODIMENTS

A distinct and full description of the technical solution of the present invention will follow by combining with the accompanying drawings.

A half-packaged flexible light strip includes a flexible circuit board 1, a transparent cover 2 with a half-packaged structure and a plurality of light sources 3. A plurality of the light sources 3 and the transparent cover 2 are all arranged on the same surface of the flexible circuit board 1. The plurality of light sources 3 is located between the transparent cover 2 and the flexible circuit board 1. Only the surface of the flexible circuit board 1 that has the light sources 3 is packaged by the transparent cover 2, and the other surface of the flexible circuit board 1 is not packaged by the transparent cover 2. The transparent cover 2 is formed by co-extrusion process and connected to the flexible circuit board 1.

Specifically, when the half packaged flexible light strip is produced, the flexible circuit board 1 is passed through an extrusion device, and the transparent cover 2 with a half-packaged structure is produced with extrusion on the flexible circuit board 1 by the extrusion device, so that the transparent cover 2 is reliably connected to the flexible circuit board 1 and only covers the surface of the flexible circuit board 1 where the light sources 3 are provided. Therefore, this arrangement reduces the use of glue, so that the emitted light will not change color when the emitted light exits through the transparent cover 2, thereby improving the light sources 3 use effect.

Specifically, the co-extrusion process is a conventional production process, and will not be repeated here.

In this embodiment, an accommodating space 4 is provided between the transparent cover 2 and the flexible circuit board 1, the plurality of light sources 3 is all located in the accommodating space 4, and the plurality of light sources 3 is all at a certain distance from an inner surface of the transparent cover 2. By leaving the accommodating space 4 between the light sources 3 and the transparent cover 2, the heat generated by the light sources 3 can be dissipated in the accommodating space 4, which avoids the accumulation of heat on the light sources 3 and causing the light sources 3 to overheat and burn out, thereby improving the service life of the light strip.

Specifically, the half-packaged flexible light strip further includes two end caps (not shown in the Figures) which are respectively arranged at two ends of the accommodating space 4. Two end caps are used to seal the openings at both ends of the accommodating space 4, so that the accommodating space 4 forms an packaged space, which prevents the light sources 3 from contacting with the outside and being contaminated, and ensures the working life of the light strip.

In this embodiment, an adhesive coating 5 for increasing adhesion is formed between the transparent cover 2 and the flexible circuit board 1. The adhesive coating 5 is a thin layer, which is used to prevent the transparent cover 2 from detaching from the flexible circuit board 1 after a long time of use, and the thin adhesive coating 5 will not affect the light transmission effect.

In this embodiment, the transparent cover 2 is made of silica gel, which has flexibility and good light transmittance.

In this embodiment, the light sources 3 are all connected to the flexible circuit board 1 by welding, so that the light sources 3 are connected to the flexible circuit board 1 stably, thereby ensuring the power connection effect.

In addition, the light strip also includes other components that are not shown. These components are located on the same surface of the flexible circuit board 1 as the light sources 3, located in the accommodating space 4 and isolated from the outside. These components are all commonly used components of the current flexible light strip, and will not be repeated here.

The above are preferred embodiments of the present disclosure merely and are not intended to limit the patent scope of the present disclosure. Any equivalent structures or modifications and variations made by those skilled in the art according to the description and the accompanying drawings of the present disclosure without departing from the idea of the present disclosure, or any equivalent structures applied in other relevant technical fields directly or indirectly are intended to be included in the patent protection scope of the present disclosure.

What is claimed is:

1. A half-packaged flexible light strip, comprising a flexible circuit board, a transparent cover with a half-packaged structure and a plurality of light sources, the plurality of light sources and the transparent cover being arranged on the same surface of the flexible circuit board, the plurality of light sources being disposed between the transparent cover and the flexible circuit board, only the surface of the flexible circuit board that has the light sources is packaged by the transparent cover, and the other surface of the flexible circuit board is not packaged by the transparent cover, and the transparent cover is formed on the flexible circuit board by co-extrusion process, and the transparent cover and the flexible circuit board are connected in an integrated structure, and an adhesive coating is coated between the transparent cover and the flexible circuit board and configured to further increase adhesion thereby prevent the transparent cover from detaching from the flexible circuit board.

2. The half-packaged flexible light strip according to claim 1, wherein an accommodating space is provided between the transparent cover and the flexible circuit board, and the plurality of light sources is all located in the accommodating space and all at a certain distance from an inner surface of the transparent cover.

3. The half-packaged flexible light strip according to claim 2, further comprising two end caps which are respectively arranged at two ends of the accommodating space, and two end caps seal openings at both ends of the accommodating space.

4. The half-packaged flexible light strip according to claim 1, wherein the transparent cover is made of silica gel.

5. The half-packaged flexible light strip according to claim 1, wherein the plurality of light sources is connected to the flexible circuit board by welding.

6. A method of forming a half-packaged flexible light strip, the half-packaged flexible light strip comprising a flexible circuit board, a transparent cover with a half-packaged structure and a plurality of light sources, wherein the method comprises:

arranging the plurality of light sources and the transparent cover on the same surface of the flexible circuit board;

disposing the plurality of light sources being between the transparent cover and the flexible circuit board;

forming the transparent cover on the flexible circuit board by co-extrusion process to connect the transparent cover with the flexible circuit board in an integrated structure, wherein only the surface of the flexible circuit board that has the light sources is packaged by the transparent cover, and the other surface of the flexible circuit board is not packaged by the transparent cover.

7. The method according to claim 6, further comprising: coating an adhesive coating between the transparent cover and the flexible circuit board to further increase adhesion thereby prevent the transparent cover from detaching from the flexible circuit board.

8. The method according to claim 6, wherein the plurality of light sources is connected to the flexible circuit board by welding.

* * * * *